US006245222B1

(12) United States Patent
Varadaraj et al.

(10) Patent No.: US 6,245,222 B1
(45) **Date of Patent: *Jun. 12, 2001**

(54) ADDITIVE ENHANCED SOLVENT DEASPHALTING PROCESS (LAW759)

(75) Inventors: Ramesh Varadaraj, Flemington; William Edward Wales, Phillipsburg, both of NJ (US)

(73) Assignee: Exxon Research and Engineering Company, Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/178,181

(22) Filed: Oct. 23, 1998

(51) Int. Cl.[7] ..... C10G 17/00; C10G 21/12; C10G 21/16; C10G 1/04

(52) U.S. Cl. ..... 208/251 R; 208/252; 208/290; 208/291; 208/309

(58) Field of Search ..... 208/251 R, 252, 208/290, 291, 309

(56) References Cited

U.S. PATENT DOCUMENTS

| | | | | |
|---|---|---|---|---|
| 2,793,167 | * | 5/1957 | Webber | 196/14.46 |
| 3,975,396 | | 8/1976 | Bushnell et al. | 208/309 |
| 4,125,458 | | 11/1978 | Bushnell et al. | 208/309 |
| 4,432,865 | * | 2/1984 | Norman | 208/183 |
| 5,000,838 | | 3/1991 | Bartilucci et al. | 208/86 |
| 5,466,365 | | 11/1995 | Savastano et al. | 208/309 |

FOREIGN PATENT DOCUMENTS 2579218 9/1985 (FR) .

* cited by examiner

*Primary Examiner*—Walter D. Griffin
*Assistant Examiner*—Tam M. Nguyen
(74) *Attorney, Agent, or Firm*—Linda M. Scuorzo

(57) ABSTRACT

The invention relates to a process for enhancing demetallation of metals containing hydrocarbonaceous feedstocks by contacting a metals containing hydrocarbonaceous feedstock at a sufficient temperature and pressure with an additive containing a polyoxyalkylene moiety said additive having preferential insolubility in alkane deasphalting solvent to produce an additive treated feedstock; and then contacting the resulting product with an effective deasphalting solvent to produce a deasphalted oil having a decreased metals content and an insoluble metals containing phase.

5 Claims, No Drawings

ADDITIVE ENHANCED SOLVENT DEASPHALTING PROCESS (LAW759)

FIELD OF THE INVENTION

The present invention relates to the solvent deasphalting of petroleum residuum.

BACKGROUND OF THE INVENTION

Solvent deasphalting is a current process for demetallation of petroleum residuum. The metals concentrate in the solvent-insoluble phase and the deasphalted oil is decreased in metals content. A limitation of art-processes is that as the yield of deasphalted oil increases, so does the metals content. There is a continuing need for refinement of the solvent deasphalting process which produces a high yield of deasphalted oil with a low metals content.

Solvent deasphalting (i.e., extraction of asphaltenes from petroleum stocks is typically accompanied with removal of organometallic, e.g., organo-nickel and vanadium and heteroatoms) is a key aspect of resid upgrading. Solvent deasphalting to produce the foregoing deasphalted oils (DAO) typically is accomplished using suitable hydrocarbonaceous solvents, in particular, hydrocarbons of straight chain paraffins and isoparaffins, containing from 3 to 7 carbon atoms. Most widely known processes are those known as Propane Deasphalting (PDA), Solvent Deasphalting (SDA) and Residual Oil Solvent Deasphalting (ROSE). Solvent deasphalting in this manner is well known in the art, see e.g., U.S. Pat. Nos. 3,975,396; 5,008,838; 5,466,365 and 4,125,458. Applicants' process addresses the "high yield/high metals" limitation of the art.

SUMMARY OF THE INVENTION

The present invention provides for a method for demetallating a metals containing residium by first treating the resid with an additive containing a polyoxy alkylene moiety, preferably an alkyl (polyoxyalkylene) moiety and then treating the resid with a hydrocarbonaceous deasphalting solvent and separating the insoluble phase from the soluble phase containing a deasphalted oil (DAO) having a decreased metals content.

The present invention may comprise, consist or consist essentially of the recited steps or elements and may be practiced in the absence of a step or element not disclosed as required.

DETAILED DESCRIPTION OF THE INVENTION

The present invention provides for a process for enhancing the metals removal capability of solvent deasphalfing processes. Solvent deasphalting is a known process for treatment of petroleum residuua (resid) in which resids are treated with a deasphalting solvent, as known in the art, e.g., alkane solvents such as butane, pentane or heptane. Included in the foregoing are isomers, if any, of the alkanes and alcohols. The process partially decreases the metals content of the deasphalted oil. The process also produces a solvent-insoluble phase (rock) in which the metals removed from the DAO are concentrated. Thus, undesirably as the yield of DAO increases so does the concentration of metals in the DAO.

Applicants have discovered that this limitation of art recognized solvent deasphalting processes can be addressed by the addition of a specific class of additives, i.e., alkane-insoluble polyoxyalkylene group-containing additives prior to addition of the deasphalting solvent. The additive chosen is one that is preferentially insoluble in the deasphalting solvent and preferentially complexes with the organometalic species present in petroleum streams, e.g., species such as organo-nickel, vanadium and iron. Preferential insolubility of the additive in the deasphalting solvent after chelating (complexing) with these metals species is also desired, and thus the deasphalting solvents are chosen such that the resulting additive complex will form a separate phase from the DAO concentrate in the solvent insoluble rock phase.

As stated previously, deasphalting solvents are suitably those known in the art preferably alkanes and related alcohols, e.g., $C_2$–$C_7$ alkanes, $C_1$–$C_7$ alcohols and mixture of said alkanes and alcohols and supercritical $CO_2$.

The additive can be added in a small amount of delivery solvent but preferably it is added as is to metals containing petroleum feed and the mixture heated with mixing to achieve sufficient contacting. Upon contacting of the additive-residuum mixture with deasphalting solvent, the resulting additive-metal complex preferentially concentrates in the solvent insoluble rock phase.

Additives suitable for use in the present invention and containing the required polyoxyalkylene group and are represented by compounds of the formula $$R—(R^1O)_m—H$$

wherein R is OH or $C_8$ to $C_{20}$ alkyl group which may be unsubstituted or substituted with substantially non-reactive or interfering groups, $R^1$ is selected from

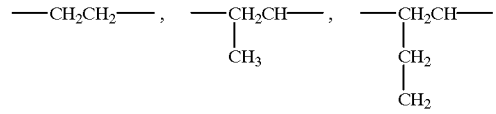

wherein when $R^1$ is an ethylene, propylene or butylene oxide moiety, and m is 5–50; and block copolymers of ethylene oxide, propylene oxide and butylene oxide monomers and mixtures thereof having 5000 to 7000 monomer units; and ethylene oxide, propylene oxide and butylene oxide derivatized ethylene diamine. These additives may be obtained from commercial sources or synthesized using known procedures. Examples of suitable additives include: ethylene oxide-polyethylene oxide-ethylene oxide block copolymers (e.g., Pluronics™ family of additives), ethylene oxide-polyethylene oxide derivatized ethylenediamine (e.g., Tectronics™ family of additives) available from BASF.

The additive is present in an effective demetallating amount, typically 0.5 to 20 wt %, preferably 0.5 to 2 wt % based on the weight of the residuum feed.

The additive is contacted with the residuum at temperatures effective to demetallate the resid to produce a treated resid having a decreased metals content. Contacting is carried out at elevated temperature necessary to liquefy or soften the metals containing residuum under pressure. Typically, treatment is at temperatures from about 80–100° C. Pressures sufficient to maintain the deasphalting solvent below its boiling point are suitable.

Deasphalting of the residuum is accomplished by contacting the additive treated residuum with a suitable amount of alkane deasphalting solvent. These are known in the art and include propane, butane, pentane and hexane. The solvents and treatment conditions are known to those skilled in the art. Typical conditions include a ratio of feed to deasphalting solvent from 1:4 to 1:14. However, solvent ratios, temperatures and pressures for deasphalting are known to those skilled in the art.

The treatment results in a DAO and a solvent insoluble material (rock). The DAO has a decreased metals content in comparison to DAO produced by solvent deasphalting without use of the additive.

Included in the types of residuua that may be treated are those having an initial boiling point of 650–1100° F. (343° C. to 593° C.), atmospheric residuum ("AR") and vacuum residuum ("VR"). However, processed feeds as known to those skilled in the art that contain undesirable metals levels which feeds will be subject to further solvent extraction processes (e.g., DAO) also may be treated. Crude oils and crude oil distillates also may be treated.

The invention is demonstrated with reference to the following examples:

EXAMPLE 1 a. The residuum fed is mixed in a suitable reactor with 0.5 to 1.0 wt % additive based on weight of the feed for 1 hour at 70–110° C. 1 atm. The treated feed is deasphalted using n-pentane at a feed:n-pentane ratio of 1:6 by volume.

b. Results (i) Results using Arab Heavy ("AH") vacuum resid ("VR") and Arab Light ("AL") atmospheric resids ("AR") are shown in Table 1 below.

TABLE 1

| Feed | Additive | Additive Conc. Wt % | Mixing Temperature ° C. | DAO Yield % | DAO V (ppm) | Ni (ppm) |
|---|---|---|---|---|---|---|
| AHVR | None | — | — | 73.0 | 64 | 17 |
| AHVR | $C_{14}H_{29}$-$(CH_2CH_2O)_7$-H | 0.5 | 110 | 74.0 | 44 | 12 |
| 1.0 | 110 | 66 | 31 | 8 | | |
| 50/50:AHVR/Toluene | $C_{14}H_{29}$-$(CH_2CH_2O)_7$-H | 1.0 | 73 | 72.0 | 42 | 12 |
| AHVR | Poly(ethylene oxide) | 1.0 | 110 | 63.O | 33 | 7.5 |
| mol. weight 300,000 | | | | | | |
| ALAR | None | — | — | 95.7 | 23.1 | 5.1 |
| ALAR | $C_{14}H_{29}$-$(CH_2CH_2O)_7$-H | 0.5 | 1 10 | 85.2 | 9.1 | ND |
| ALAR | $C_{14}H_{29}$-$(CH_2CH_2O)_7$-H | 1.0 | 110 | 87.1 | 7.9 | <3.2 |

EXAMPLE 2

Results using an Exxon Baytown refinery deasphalted oil feed is shown in Table 2 below.

TABLE 2

| | % Yield of | % Demet. (ICP data) | | % Demet (ESR data) |
|---|---|---|---|---|
| Additive | Treated Feed | V | Ni | V |
| Tetronic 908 | 92 | 23 | 24 | 25 |
| Pluronic F-88 | 96 | 21 | 29 | 30 |

Pulronic is a block copolymer of ethylene oxide propylene oxide, Pluronic F-88 has molecular weight of 11,400.

Tetronic is a tetra-functional block copolymer derived from the sequential addition of propylene oxide and ethylene oxide to ethylene diamine. Tetronic 908 has mol. weight= 25,000.

What is claimed is:

1. A process for enhancing demetallation of metals containing hydrocarbonaceous feedstocks, consisting essentially of:

(a) contacting a metals containing hydrocarbonaceous feedstock at a sufficient temperature and pressure with an additive consisting of a polyoxy-alkylene moiety said additive having preferential insolubility in alkane deasphalting solvent to produce an additive treated feedstock, (b) contacting the product of step (a) with an effective deasphalting solvent to produce a deasphalted oil having a decreased metals content and an insoluble metals containing phase.

2. The process of claim 1 wherein the feedstock is selected from crude oils, crude oil distillates, crude residuua and oils derived from crude residua.

3. The process of claim 1 wherein the deasphalting solvent is selected from $C_1$ to $C_7$ alcohols, $C_2$ to $C_7$ alkanes, and mixtures of said alkanes and alcohols, and supercritical fluid $CO_2$.

4. The process of claim 1 wherein the polyoxyalkylene moiety is an alkyl (polyoxyalkylene) moiety.

5. The process of claim 1 wherein the alkyl (polyoxyalkylene) moiety is represented by the formula $$R—(R^1O)_m—H$$

wherein R is OH or $C_8$ to $C_{20}$ alkyl group which may be unsubstituted or substituted with substantially non-reactive or interfering groups, $R^1$ is selected from

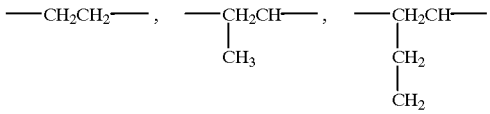

wherein when $R^1$ is an ethylene, propylene or butylene oxide, and moiety m is 5–50, and block copolymers of ethylene oxide, propylene oxide and butylene oxide monomers and mixtures thereof having 5000 to 7000 monomer units; and ethylene oxide, propylene oxide and butylene oxide derivatized ethylene diamine.

* * * * *